United States Patent [19]

Bettini

[11] Patent Number: 4,784,503

[45] Date of Patent: Nov. 15, 1988

[54] SERIAL DOT PRINTER WITH MOVABLE HEAD-CARRYING CARRIAGE

[75] Inventor: Francesco Bettini, Ivrea, Italy

[73] Assignee: Ing. C. Olivetti & C., S.p.A., Ivrea, Italy

[21] Appl. No.: 24,457

[22] Filed: Mar. 11, 1987

[30] Foreign Application Priority Data

Mar. 11, 1986 [IT] Italy ..... 67191 A/86

[51] Int. Cl.[4] ..... B41J 25/30

[52] U.S. Cl. ..... 400/320; 400/59; 400/322; 400/328; 400/352; 400/705.1

[58] Field of Search ..... 400/59, 320, 322, 328, 400/352, 719, 705.1; 74/37

[56] References Cited

U.S. PATENT DOCUMENTS

| | | | |
|---|---|---|---|
| 3,826,915 | 7/1974 | Giolitti et al. | 346/74 |
| 4,084,681 | 4/1978 | Heinzl | 400/320 X |
| 4,181,443 | 1/1980 | Hirabayashi | 400/320 |
| 4,189,244 | 2/1980 | Harrison | 400/320 X |
| 4,266,456 | 5/1981 | Oostuogels | 74/37 X |
| 4,372,698 | 2/1983 | Matsushima | 400/320 |
| 4,395,145 | 7/1983 | Giacone | 400/59 |
| 4,416,560 | 11/1983 | Wood | 400/320 X |
| 4,428,693 | 1/1984 | Bovio et al. | 400/126 |
| 4,518,272 | 5/1985 | George | 400/705.1 |

FOREIGN PATENT DOCUMENTS

| | | | |
|---|---|---|---|
| 87983 | 6/1982 | Japan | 400/705.1 |

OTHER PUBLICATIONS

*IBM Tech. Disc. Bulletin*, by E. Hungarter, vol. 22, No. 12, May 1980, p. 5303, 400-719.

*Primary Examiner*—Paul T. Sewell

*Attorney, Agent, or Firm*—Banner, Birch, McKie & Beckett

[57] ABSTRACT

The carriage is displaced by a tooth belt which is moved continuously by an electric motor and is connected to the carriage be means of an element engaged between two teeth of the belt and slidable on the carriage in a direction perpendicular to the direction of displacement of the carriage. The pulleys are provided with a recess capable of engaging the element in such a way as to move it positively in said perpendicular direction. The carriage is also connected by means of a tension spring to a strip provided with areas of an optical encoder in respect of the print positions. The upper paper pressure arrangement is formed by two rollers carried by two sliders fitted into corresponding longitudinal slots in the fixed support. The paper is carried by a feed reel which is carried by two arms which can be fitted by catch engagement on corresponding shoulders on the fixed support. The printer is particularly suitable for being connected to the output of a personal or home computer.

8 Claims, 3 Drawing Sheets

SERIAL DOT PRINTER WITH MOVABLE HEAD-CARRYING CARRIAGE

BACKGROUND OF THE INVENTION

The present invention relates to a serial dot printer with a movable carriage-carrying head wherein the head is capable of printing during each travel movement of the carriage in both directions, said carriage being displaced by an electric motor which rotates continuously in one direction.

In a known printer of a typing or word-processing computer, the carriage is moved for a relatively short distance with a harmonic motion generated by an element disposed eccentrically with respect to a drive shaft. That motion arrangement is generally bulky and cannot be used when the printer is to print graphics or alpha-numeric texts on a page, for which purpose the travel movement of the carriage becomes relatively long.

The technical problem of the present invention is that of providing an arrangment for displacing the carriage, which is simple and compact, being suitable for a serial printer which can be connected as an output device of a personal or home computer.

SUMMARY OF THE INVENTION

That technical problem is solved by the serial printer with a movable head-carrying carriage, which is characterised in that said carriage comprises an element connected to a flexible ring-like member which is displaced by said motor by way of two pulleys disposed in such a way as to hold two portions of the flexible member parallel to the direction of displacement of the carriage, said element being displaceable on said carriage in a direction perpendicular to the direction of displacement of the carriage.

BRIEF DESCRIPTION OF THE DRAWINGS

These and other features of the invention will be more clearly apparent from the following description of a preferred embodiment which is given by way of example with reference to the accompanying drawings in which.

DETAILED DESCRIPTION OF THE PREFERRED EMBODIMENT

Figure 1:
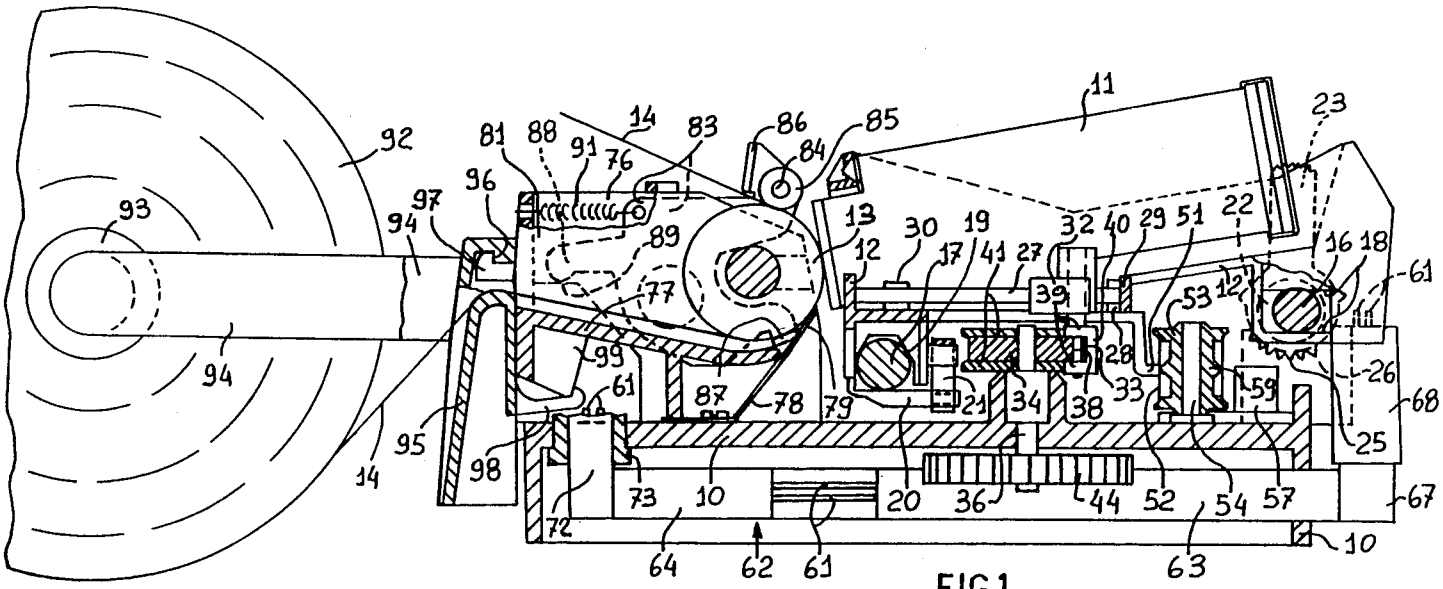
FIG. 1 is a view in longitudinal section of a serial dot printer according to the invention.

Referring to FIG. 1, reference numeral 10 generally indicates the fixed frame structure of a serial printer comprising a dot printing head 11 mounted removably on a carriage 12. The head 11 is of the ink jet type substantially as described in the U.S. Pat. No. 4,703,332 assigned to the same Assignee. The head 11 can therefore be actuated to print a dot at a time on a sheet of paper 14 carried by a roller 13.

The carriage 12 is displaceable transversely with an alternating movement on two cylindrical metal guides

16 and 17 carried by the frame structure 10. In particular the carriage 12 slides on the rearward guide 16 by means of a mounting seat 18 while it slides on the forward guide 17 by means of two V-shaped mounting seats 19. Two friction tongue portions 20 (see also FIG. 2) are held against the guide 17 by a blade spring 21, as described in the above-mentioned patent application.

Figure 6:
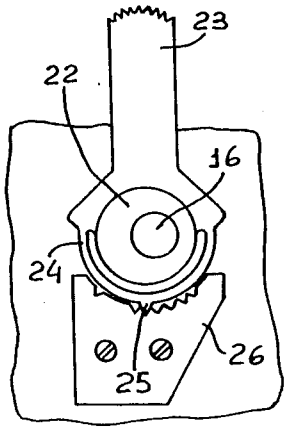
FIG. 6 is a view of part of the arrangement showing a detail from FIG. 2, along line VI—VI therein.

For the purposes of adjusting the position of the printing head 11 with respect to the roller 13, the guide 16 is fixed eccentrically on two circular plastic eccentric members 22 (see FIG. 1) which are rotatable on two corresponding mounting seats on the two side portions of the frame structure 10. Each eccentric member 22 is in one piece with a manually operable lever 23 (see FIG. 6) which on a resilient sector 24 carries a positioning tooth 25 co-operating with a fixed toothed sector 26. By rotating the two levers 23, it is possible to adjust with a very high level of accuracy the direction of the axis of the head 11, both vertically and transversely.

Figure 4:
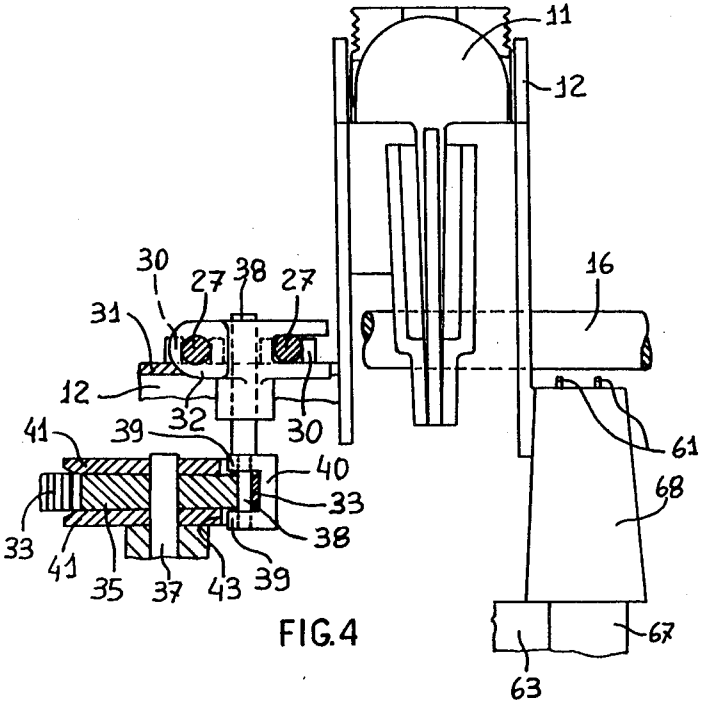
FIG. 4 is a view in section taken along line IV—IV in FIG. 2 on an enlarged scale.

The carriage 12 carries two cylindrical metal bars 27 (see FIG. 2) disposed in a direction perpendicular to the direction of displacement of the carriage 12 and thus perpendicular to the guides 16 and 17. Each bar 27 is inserted on the one hand into a U-shaped mounting seat 28 of a vertical wall 29 of the carriage 12 and on the other hand between two latching projections 30 (see FIG. 4) on a horizontal portion 31 of the carriage 12. An element or small block member 32 which is fixed on a toothed belt 33 is slidable on the two bars 27. The belt 33 engages two toothed pulleys 34 and 35 (see FIG. 2) which are fixed on two vertical shafts 36 and 37 mounted rotatably on the frame structure 10.

In particular, fixed to the block member 32 is a pin 38 rotatably supporting two bored limbs 39 (see FIG. 4) of a C-shaped member 40 which is arranged to embrace the belt 33. The pin 38 is capable of engaging between two adjacent teeth of the belt 33 whereby the block member 32 is constantly locked to the belt 33. Each of the two pulleys 34 and 35 is provided with two flanges 41 for preventing axial displacement of the belt 33 on the respective pulley. Each pulley 34 and 35 lacks a tooth, in the place of which it has a depression or groove 42 to permit engagement of the pin 38 therein. In a corresponding fashion, the two flanges 41 of each pulley 34 and 35 are provided with a respective recess 43 for accommodating the respective limbs 39 of the block member 32.

The two pulleys 34 and 35 (see FIG. 2) are mounted in such a way that the depression 42 and the recesses 43 engage the pin 38 and the limbs 39 when the carriage 12 is moved into a region beside the region of printing on the paper 14, in which reversal of the movement of the carriage 12 takes place. In particular the pulleys 34 and 35 are mounted in such a way that, when the depressions 42 are on the plane common to the two shafts 36 and 37, they are in mirror-image relationship.

The shaft 36 is extended below the frame structure 10 and is fixed with respect to a toothed pulley 44 (see FIG. 1). By way of a toothed belt 45 (see FIG. 2), the pulley 44 is connected to a pulley 46 fixed on the shaft 47 of an electric motor 48.

The carriage 12 is also provided with two projections 49 and 51, while the two ends of a strip or ribbon 52 are hooked to the projections 49 and 51. The strip 52 is guided around two pulleys 53 which are rotatable on two fixed pins 54 on the frame structure 10 and disposed in a plane parallel to that of the shafts 36 and 37 but at a greater spacing than the spacing between the shafts 36 and 37. The strip 52 is of Mylar and comprises a portion 55 (see FIG. 3) whose length is at least equal to the line of printing and is provided with a series of transparent areas 56 at a mutual spacing equal to the pitch of the dot printing matrix. The areas 56 are such that they can be read by an optical reader 57 (see FIG. 2) of a synchronising signal generator which, with the strip 52, forms the optical encoder in respect of the print positions of the head 11.

The two ends of the strip 52 are apertured. One end of the strip 52 is hooked directly on to the projection 49 on the carriage 12 while the other end of the strip 52 is hooked on to the projection 51 of the carriage 12 by means of a tension spring 58 which holds the strip 52 under a constant tension. The pulleys 53 are provided with an intermediate rib 59 (see FIG. 1) to prevent the pulleys from coming into contact with the region bearing the areas 56 on the strip 52, which is read by the reader 57.

Figure 5:
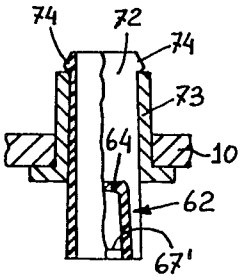
FIG. 5 is a view in section taken along line V—V in FIG. 2, also on an enlarged scale.

The print head 11 is energised by a pilot control circuit fixed on the frame structure 10, by way of a pair of flexible electrical cables 61. To prevent the cables 61 from moving freely between the frame structure 10 and the carriage 12 during the travel movements of the latter, the cables 61 are fitted into a plastics sheath 62 (see FIG. 2) which is substantially L-shaped and which has the two side portions 63 and 64 of the L-shape sheath formed by two rigid portions of U-shaped section (see FIG. 5). The two side portions 63 and 64 are connected by a third flexible portion 66 (see FIG. 2), with a section formed by one side only of the U-shape. A series of cross members 67' (see FIG. 5) hold the cables 61 in the sheath 62.

The free end of the side portion 63 integrally carries a tubular portion 67 (see FIG. 2) which is fitted into a cylindrical seat 68 in the carriage 12 in such a way as to be capable of rotating therein. The projection 69 on the portion 67 is fitted in a bayonet-type fitting into a recess 71 in the seat 68, to prevent the projection 69 from coming out of the seat 68. The free end of the portion 64 integrally carries another tubular portion 72 which is fitted rotatably into a cylindrical seat 73 on the frame structure 10. Two projections 74 on the portion 72 prevent the latter from coming out of the seat 73 (see FIG. 5).

During the printing operation, the electric motor 48 (see FIG. 2) is rotated continuously and, by way of the pulley 46, the belt 45 and the pulley 44, causes clockwise rotary movement of the shaft 36 together with the pulley 34. The pulley 34 drives the belt 33 which in turn rotates the pulley 35 in the same direction. The belt 33, by way of the pin 38, in turn entrains the block member 32 together with the carriage 12. In particular, when the portion of the belt 33 which engages the pin 38 is to the right of the shafts 36 and 37 as shown in FIG. 1, the carriage 12 can move from right to left while when it is to the left, the carriage moves from left to right.

When the carriage 12 moves with the pin 38 into a position corresponding to one of the pulleys 34 and 35 (see FIG. 2), that pulley, in a position corresponding to the pin 38, has the depression 42 while the two flanges 41 of the pulley 34 or 35 present the associated recesses 43 to the limbs 39 of the member 40. The depression 42 then positively entrains the pin 38 around the pulley 34 and 35 while the recesses 43 cause rotation of the member 40 about the pin 38 through 180°, thus avoiding any excessive force applied by the belt 33 to the pin 38 and any sliding movement on the part of the limbs 39 against the flanges 41. In that way the carriage 12 is continuously displaced with an alternating movement along the line of printing. It will be appreciated that the line of printing is of a shorter length than the spacing between the shafts 36 and 37 whereby printing is effected during the displacement of the carriage 12 at a constant speed in both directions.

The carriage 12, in its alternating movement, entrains the strip 52 by way of the projections 49 and 51. The strip 52 causes the zone 55 (see FIG. 5) provided with the areas 56 to move with an alternating movement with respect to the reader 57 (see FIG. 2), thereby synchronising the pulses for controlling the dot printing operation effected by the head 11.

Figure 2:
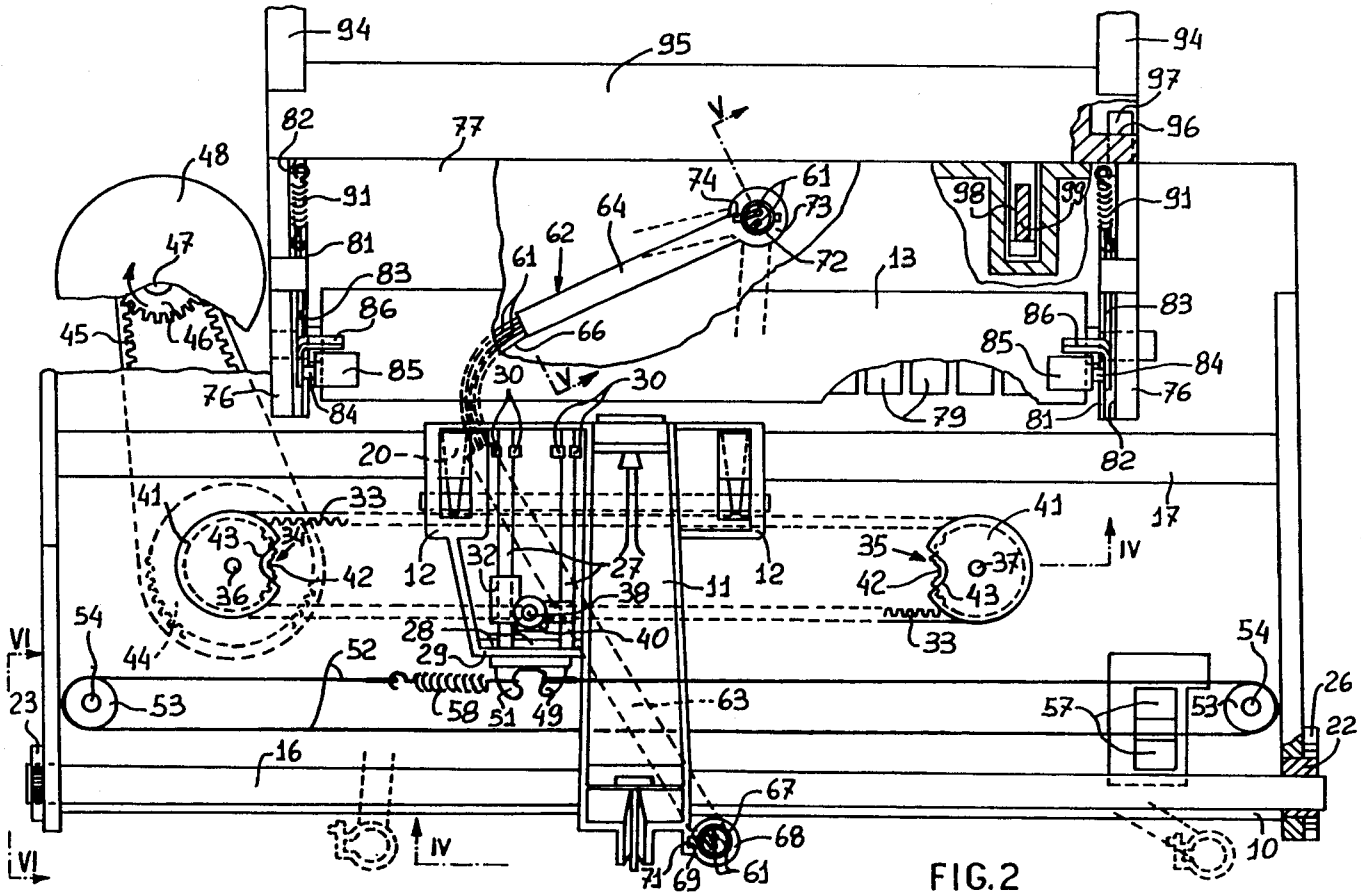
FIG. 2 is a plan view of the printer shown in FIG. 1.
Figure 3:
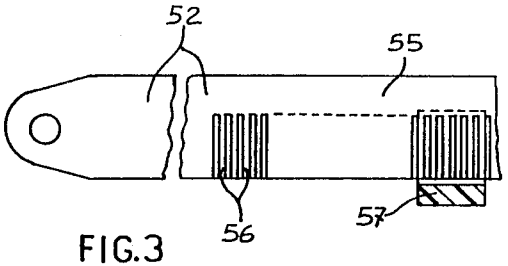
FIG. 3 is a view of a detail of the printer.

During the displacement of the carriage 12, the seat 68 on the carriage 12 entrains the portion 67 of the sheath 62 which is moved between the two limit positions shown in broken lines in FIG. 2. The flexible portion 66 permits a certain variation in the angle between the two portions 63 and 64 in moving from the limit positions in which the portions 63 and 64 are more widely spread apart to the central position in which those portions are more closed together.

The platen roller 13 is mounted rotatably on two side walls 76 of a plastics support 77 (see FIG. 1) which is fixed to the frame structure 10. Fixed between the support 77 and the frame structure 10 is a bent plate 78 having a series of limb portions 79 (see FIG. 2) which bear resiliently against the platen roller 13, forming the lower paper guide arrangement.

Disposed adjacent each wall portion 76 is a second wall portion 81 which forms therewith a mounting seat 82 for a metal slider 83 (see FIG. 1). Each slider 83 carries a pin 84 which rotatably supports a roller 85 acting as an upper paper pressure arrangement with respect to the platen roller 13. Each slider 83 is provided with a first manually operable bent limb 86 and a second bent limb 87 co-operating with the roller 13 to form the lower paper pressure arrangement. Finally each slider 83 is provided with a projection 88 which is normally held in contact against a shoulder 89 of the seat 82 by a spring 91. The spring 91 thus holds the corresponding limb 87 and the corresponding roller 85 in a position of bearing against the roller 13.

The paper 14 used for the printing operation may be in the form of a reel 92 which is for example pre-printed as continuous modules. The reel 92 comprises a core member 93 which is mounted on a pair of symmetrical arms 94 carried by a C-shaped structure 95. The structure 95 comprises a pair of shoulders 96 capable of engaging over two catch projections 97 on the support 77, and a pair of resilient projections 98 which come into latching engagement over a corresponding pair of shoulders 99 carried by the support 77. The structure 95 can therefore be easily removed from its mounting seat either to replace the roll 14 or to use individual sheets of paper.

It will be appreciated that various modifications and improvements may be made in the above-described printer without departing from the scope of the present invention.

We claim:

1. A serial dot printer including a transversely movable carriage, a printing head capable of printing dots during each stroke of the carriage in both directions, a closed loop toothed belt trained round a pair of toothed pulleys so as to have two parallel runs extending in the direction of movement of the carriage, a continuously rotating electric motor for driving one of said pulleys in one rotating direction, and drive means attached to said belt and coupled to said carriage so as to move the carriage alternately in said two directions when said drive means moves along a first one and a second one of said runs, said drive means including an element secured to said belt in a gap between two consecutive teeth thereof, said pulleys being each one provided with at least one groove to house said element when said drive means runs round said pulleys, said pulleys being each one provided with a pair of circular flanges, wherein said drive means includes a block member slidably guided on a pair of rectilinear bars provided on said carriage perpendicular to its displacement direction, a C-shaped member embracing said belt and having a pair of limbs each one substantially coplanar with one flange of each of said pair of flanges, each one of said limbs being adapted to engage a recess provided in each flange coplanar thereto, said element being formed of a pin carried by said block member and mounted on said limbs as to block said C-shaped member on said belt, said pin being rotatably coupled at least with one of said C-shaped member and said block member so as to cause said C-shaped member to rotate when moving round said pulleys.

2. A printer according claim 1, wherein said head is actuated under the control of an optical position encoder characterised in that said optical encoder comprises a flexible strip guided around two associated pulleys disposed in such a way as to hold two portions parallel to the displacement of the carriage, the ends of said strip being connected to the carriage, a region of said strip being provided with an equidistant series of reference means corresponding to the printing positions of the head,, said references means being displaced with an alternating movement with respect to an optical reader to generate the synchronisation signals.

3. A printer according to claim 2, characterised in that said associated pulleys are so shaped as to prevent said associated pulleys coming into contact with the reference means to be read, at least one end of said strip being connected to the carriage by means of a tension spring capable of holding the strip continuously under a constant tension.

4. A printer according claim 1, wherein said head is actuated by means of flexible electrical conductors anchored on the one end to the fixed frame structure of the printer and on the other end to said carriage, characterised in that said conductors are inserted into a substantially L-shaped sheath having two side parts formed by two rigid portions connected by a third flexible portion.

5. A printer according to claim 4, characterised in that said two rigid portions of the sheath are of a U-shaped section, said third portion having a section formed by only one side of the U-shape.

6. A printer according to claim 5, characterised in that the two ends of said sheath carry two cylindrical elements capable of rotating in two corresponding seats on said frame structure and said carriage.

7. A printer according claim 1, comprising a platen roller and a support for said roller, characterised in that said support is provided with two seats in which two members are displaceable, said members each carrying a pair of paper pressure elements, each member being held resiliently in a condition of bearing against a shoulder of said seat and with said elements bearing against the roller.

8. A printer according to claim 7, characterised in that said support has two pairs of rearward shoulders upon which two pairs of resilient projections in one piece with a C-shaped body for supporting a reel of paper can be latchingly engaged.

* * * * *